US011397408B2

(12) United States Patent
Vardi et al.

(10) Patent No.: US 11,397,408 B2
(45) Date of Patent: Jul. 26, 2022

(54) AUTOMATICALLY STARTING AND SECURED DETENT ESCAPEMENT FOR A TIMEPIECE

(71) Applicant: Société anonyme de la Manufacture d'horlogerie Audemars Piguet & Cie, Le Brassus (CH)

(72) Inventors: Ilan Vardi, Neuchâtel (CH); Simon Henein, Neuchâtel (CH); Olivier Mathez, La Chaux-de-Fonds (CH)

(73) Assignee: Société anonyme de la Manufacture d'horlogerie Audemars Piguet & Cie, Le Brassus (CH)

( * ) Notice: Subject to any disclaimer, the term of this patent is extended or adjusted under 35 U.S.C. 154(b) by 727 days.

(21) Appl. No.: 16/388,728

(22) Filed: Apr. 18, 2019

(65) Prior Publication Data

US 2019/0361397 A1 Nov. 28, 2019

(30) Foreign Application Priority Data

May 25, 2018 (CH) ..... 00664/18

(51) Int. Cl.
*G04B 15/14* (2006.01)
*G04B 15/08* (2006.01)

(52) U.S. Cl.
CPC ..... *G04B 15/14* (2013.01); *G04B 15/08* (2013.01)

(58) Field of Classification Search
CPC ..... G04B 15/08; G04B 15/14
(Continued)

(56) References Cited

U.S. PATENT DOCUMENTS 3,826,076 A 7/1974 Tuetey
6,997,602 B2 2/2006 Mojon et al.
(Continued)

FOREIGN PATENT DOCUMENTS

CH 347484 6/1960
CH 567 293 B5 9/1975
(Continued)

OTHER PUBLICATIONS

"The detent escapement: from marine chronometers to wristwatches," www.timeandwatches.com, 7 pages (retrieved on May 15, 2018).

*Primary Examiner* — Edwin A. Leon
*Assistant Examiner* — Kevin Andrew Johnston
(74) *Attorney, Agent, or Firm* — Christensen, Fonder, Dardi & Herbert PLLC

(57) ABSTRACT

A horological detent escapement for a horological movement arranged to transmit a torque from said horological movement to an oscillating regulating organ of said horological movement, the regulating organ comprising a first mobile body and the escapement comprising a second mobile body and an escapement wheel. Said escapement wheel being arranged so as to transmit, during a half-phase of each oscillation of the regulating organ, a torque to said regulating organ via a direct impulse. The second mobile body comprises an indirect impulse means arranged so as to be in contact with the escapement wheel during normal operation and be out of contact during the other half-phase of each oscillation of the regulating organ when the escapement wheel does not transmit torque to the regulating organ, so as to transmit torque to said regulating organ via an indirect impulse, following an inadvertent movement or inadvertent stoppage of the horological movement.

18 Claims, 5 Drawing Sheets

(58) Field of Classification Search
USPC ..... 368/132, 124
See application file for complete search history.

(56) References Cited

U.S. PATENT DOCUMENTS

| | | | | |
|---|---|---|---|---|
| 7,097,350 | B1 | 8/2006 | Conus et al. | |
| 2010/0149926 | A1 | 6/2010 | Colpo et al. | |
| 2010/0214881 | A1 | 8/2010 | Chiuvé et al. | |
| 2011/0310709 | A1* | 12/2011 | Vaucher | G04B 15/08 368/127 |
| 2012/0113764 | A1 | 5/2012 | Queval | |
| 2013/0070570 | A1 | 3/2013 | Colpo et al. | |
| 2015/0029827 | A1 | 1/2015 | Koda et al. | |
| 2017/0090422 | A1 | 3/2017 | Cusin et al. | |
| 2018/0231936 | A1* | 8/2018 | Fukuda | G04B 15/14 |

FOREIGN PATENT DOCUMENTS

| | | | | |
|---|---|---|---|---|
| CH | 712 288 | A1 | 9/2017 | |
| CH | 712288 | A1 * | 9/2017 | G04B 15/08 |
| CN | 102467071 | A | 5/2012 | |
| CN | 102971678 | A | 3/2013 | |
| CN | 104898396 | A | 9/2015 | |
| CN | 104898397 | A | 9/2015 | |
| CN | 106707718 | A | 5/2017 | |
| EP | 0 018 796 | A2 | 11/1980 | |
| EP | 0018796 | A2 * | 11/1980 | G04B 15/08 |
| EP | 1 122 617 | A1 | 8/2001 | |
| EP | 1122617 | A1 * | 8/2001 | G04B 15/08 |
| EP | 1 708 046 | A1 | 10/2006 | |
| EP | 2 224 292 | B1 | 9/2010 | |
| EP | 2 450 755 | A1 | 5/2012 | |
| EP | 3 070 537 | A1 | 9/2016 | |
| EP | 3 121 660 | A1 | 1/2017 | |
| EP | 3 121 661 | A1 | 1/2017 | |
| EP | 3121660 | A1 * | 1/2017 | G04B 15/08 |
| EP | 3 147 725 | A1 | 3/2017 | |
| EP | 3 153 935 | A1 | 4/2017 | |
| EP | 3 206 088 | A1 | 8/2017 | |
| JP | 2004-245838 | A | 9/2004 | |
| WO | WO 2017/033688 | A1 | 3/2017 | |
| WO | WO 2017/125194 | A1 | 7/2017 | |

* cited by examiner

AUTOMATICALLY STARTING AND SECURED DETENT ESCAPEMENT FOR A TIMEPIECE

RELATED APPLICATION

The present application claims priority to Swiss Patent Application No. 00664/18, filed May 25, 2018, the disclosure of which is hereby incorporated by reference herein in its entirety.

FIELD OF THE INVENTION

The present invention relates to a horological escapement of the detent type as well as to a horological movement and a timepiece, in particular a mechanical watch, comprising such an escapement. More particularly, the present invention concerns a horological detent escapement which is adapted to be integrated into a horological movement and is arranged to transmit a torque originating from an energy source of said horological movement to an oscillating regulating organ of said horological movement, the regulating organ of the horological movement comprising a first mobile body and the escapement comprising a second mobile body as well as an escapement wheel, said first mobile body cooperating with said second mobile body by being capable of stopping the second mobile body in a first or a second position, defined respectively by a first and a second banking against which said second mobile body comes to rest, said escapement wheel being arranged so as to transmit, during a half-phase of each oscillation of the regulating organ, a torque to said regulating organ by means of a direct impulse.

BACKGROUND OF THE INVENTION

With the escapement being one of the key elements of a horological movement, a great number of horological escapements of different types exist. In general, within the scope of mechanical timepieces, there exists the family of permanent contact escapements, in which the oscillating regulating organ of the movement, the balance, is constantly in contact with a part of the escapement, and the family of free escapements, in which the balance has no contact with the escapement except during the unlocking and the impulse.

The family of free escapements last cited itself includes several types of escapements. Amongst others, this family includes the Swiss lever escapement, which represents the great majority of horological escapements which are currently used in wristwatches having a mechanical movement. The person skilled in the art has perfect knowledge of the components as well as of the functioning of this type of escapement, which is illustrated schematically in FIG. 1A, for which reason the structure, functioning and corresponding nomenclature will not be repeated here. Likewise, the person skilled in the art knows that a Swiss lever escapement is usually equipped with a part designated "guard-pin" g in order to prevent what is known in horology under the term "overbanking" of the pallets c which results in the immediate stoppage of the balance, respectively of the corresponding timepiece. Without a guard-pin, an overbanking of the pallets of such an escapement can occur during certain phases of its functioning, namely while the balance travels through its supplementary arc and the pallets c are positioned against one or other of the limitation bankings i.e., for example following a shock which separates the pallets c from their target position and brings them prematurely against the other limitation banking e, so that the pin t of the impulse roller i of the balance will no longer meet the notch but accidentally meets the back of one of the horns of the fork f of the pallets c, resulting in the immediate stoppage of the balance. The use of a guard-pin g, which is a small metal pin fixed in the block at the end of the fork f of the lever escapement, allows to avoid this problem due to the fact that the guard-pin g works with safety roller h carried by the axis of the balance j and prevents accidental displacements of the fork f during the supplementary oscillation arc of the balance. Due to these geometric constraints, a Swiss lever escapement is secured fairly well against shocks and lends itself particularly well to being used in wristwatches.

The family of free escapements also includes the escapement designated as detent escapement which is illustrated schematically in FIG. 1B and which is considered as the best escapement from the point of view of chronometry. As the principles of a detent escapement have been known for a long time, they will not be repeated here, either, but—in order to facilitate the understanding of the present invention and also its context—it is to be recalled that it concerns a direct impulse escapement, unlike the Swiss lever escapement mentioned above which belongs to the family of indirect impulse escapements in which the impulse is transmitted from the escapement wheel to the balance by means of the pallets. In a detent escapement, briefly, the teeth of an escapement wheel f rest on a jewel called the locking-stone a and carried by a spring called the detent b, an extension of which is situated within the range of action of a discharging pallet c, the latter operating the unlocking of the escapement wheel each time the balance oscillates, so that a tooth of the escapement wheel f leaves the locking-stone a and another of its teeth, acting on the impulse-pallet e carried by the impulse roller d, gives an impulse to the balance. The impulse is therefore transmitted directly by the escapement wheel to the balance, which as a consequence has a certain number of advantages. This includes, amongst others, the fact that (a) the escapement disturbs the balance to a lesser extent, given that there is only a single impulse per oscillation period, compared to the Swiss lever escapement which disturbs the balance twice per period. In other words, the detent escapement has what the person skilled in the art knows under term "single beat", i.e. a half-oscillation without impulse. A direct impulse escapement also has (b) a better efficiency due to the direct transmission of the impulse from the escapement wheel to the balance, without passing via a supplementary component such as the pallets, which entails a loss of efficiency. In addition (c), owing to the fact that the impulse is carried out along a direction which is orthogonal to the line linking the centres of the escapement wheel and of the balance and to the absence of an impulse transmitted at the level of the pallets, the friction during the impulse and also the risk of butting are reduced, which allows the need for lubrication to be eliminated. Furthermore, (d) the fact that a single beat exists permits a precise setting of the position of the single impulse by oscillation with respect to the dead-point of the oscillator, which is not possible in Swiss lever escapements having two impulses per oscillation period, given that a setting of the positioning of the impulse before or after the dead-point in a half-oscillation results in a mis-setting of the positioning of the impulse in the other half-oscillation. In addition, (e) the detent escapement illustrated in FIG. 1B does not have pallets and therefore has a certain mechanical simplicity compared to the Swiss lever escapement. All these advantages result in a better precision and a greater autonomy of the direct impulse escapements by comparison with indirect impulse escapements, for which reason the industrial exploitability of the detent escapement, i.e. with direct impulse, is of interest for the horological industry. However, the detent escapement has a major disadvantage, namely that it is not constrained geometrically to minimize the effect of shocks. Although the detent escapement has been used for approximately two centuries, in particular in marine chronometers, the freedom given to the oscillating regulating organ by the detent escapement has the result that it cannot be used as it is in wristwatches.

For this reason, several variants using the principle of the detent escapement have been realized by the past in order to retain certain of its advantages for the wristwatch. To cite some of the approaches envisaged by the past, the escapement of the Robin type can be named, and its securing as realized by the applicant of the present patent application. As the principles of an escapement of the Robin type have been known since 1791, they will not be repeated here either, but it is to be recalled that this also concerns a direct impulse escapement in which the detent spring is replaced by pallets, as illustrated schematically in FIG. 1C. Although the Robin escapement illustrated in FIG. 1C has the above-mentioned advantages (a) to (d) of the detent escapement, it must be stated that its pallets are not sufficiently constrained, so that the Robin escapement is not secured in the event of shocks and therefore does not lend itself either, as it is, for use in wristwatches. In addition, an inadvertent stoppage of the corresponding movement can result in the total stoppage over a long duration of a watch equipped with such an escapement, since there are situations in which an automatic restarting, i.e. exclusively under the effect of the torque of the escapement wheel without exterior excitation, of any single-beat escapement such as the Robin escapement is impossible. In fact, the self-starting after a stoppage in which the barrel spring is completely discharged is not ensured in this type of escapement, given that, owing to the single beat, there exists the possibility of a stoppage in a position of rest in which the self-starting is impossible since the immobile balance cannot free the escapement wheel.

In order to remedy the problem of the securing of an escapement of the Robin type against shocks, the applicant of the present patent application has developed in the year 2000 an escapement of the Robin type, hereinafter also designated as AP escapement, which is secured against shocks, as described in detail in the specification of European patent EP 1 122 617, the content of which is incorporated into the present description by reference. In order to facilitate the understanding of the context of the present invention, without literally repeating the whole of the technical instruction of said European patent, it is to be noted that the central interest of the horological escapement according to European patent EP 1 122 617 is to render industrially exploitable an escapement of the Robin type for wristwatches by giving it a locking device replacing the guard-pin of a Swiss lever escapement. In fact, the use of a conventional guard-pin as defined above is only possible in a lever escapement having a sufficiently large angular excursion of the pallets. As set out in detail in European patent EP 1 122 617, this is not the case, however, in an escapement of the Robin type which has a much smaller angular excursion of the pallets. The invention according to European patent EP 1 122 617 has allowed the escapement of the Robin type to be rendered industrially exploitable and to be integrated into wristwatches by proposing a specific locking device which fulfils the same function as a conventional guard-pin, but which is adapted to be used, unlike a conventional guard-pin, also in the case of a smaller angular excursion of the pallets than in the Swiss lever escapements. As illustrated schematically in FIG. 1D, this specific locking device replaces the conventional guard-pin cooperating with an indentation of the safety roller of the balance, in brief, by a guard-pin 2.2 modified on its end oriented towards the balance where it has a finger 2.2.3 adapted to cooperate with a skirt 1.2.1 mounted on a circular plate 1.2 of the balance and having internal 1.2.1.1. and external 1.2.1.2 walls, said skirt 1.2.1 having a notch 1.2.1.3 arranged so as to be traversed by said finger 2.2.3. In other words, the simple pin formed by the conventional guard-pin and the corresponding indentation of the safety roller of the balance, working solely in a plane perpendicular to the axis of the balance, have been replaced by a finger mounted in an orthogonal manner to the direction of longitudinal extent of the modified guard-pin as well as the internal and external walls of said skirt, including its notch, these parts having a more complex geometry and working as well in the plane perpendicular—as that parallel to the axis of the balance. This step permits the use of such a locking device also in combination with a direct impulse escapement, in particular of the Robin type, and has allowed the applicant of the present patent application, since the year 2000, to mass-produce and market an escapement of the Robin type in mechanical wristwatches. Furthermore, the applicant of the present patent application has further improved the securing against shocks of an escapement of the Robin type in the year 2016, as described in detail in the patent application CH 712 288, the content of which is integrated in the present description by reference. In brief, the improvement consists of integrating in said specific locking device, i.e. in the modified guard-pin which lends itself to a use in an escapement of the Robin type, a securing and guiding surface arranged and positioned such as to prevent the pallets from returning, after an inadvertent movement, on the trajectory of the escapement wheel. Although the AP escapement illustrated in FIG. 1D has, like its improved variant and the Robin escapement, the above-mentioned advantages (a) to (d) of the detent escapement and, in particular, has no need of lubrication, it must be noted that it presents the disadvantages of the Robin escapement which are independent of the securing against shocks, in particular that the self-starting after stoppage with the barrel spring being completely discharged is not always ensured. In addition, as mentioned in the patent application CH 712 288 and despite the generally very good functioning of an AP escapement according to European patent EP 1 122 617, there exist, in the version of the AP escapement of the year 2000, some rare constellations in which a collision between the finger of the guard-pin and the skirt of said specific locking device can occur, due to quite close mechanical tolerances of the parts which are used, this problem being reduced by the integration of said securing and guiding surface.

Another approach using the principle of the detent escapement so as to retain some of its advantages for the wristwatch has been realized by the horologist George Daniels, who devised an escapement designated as a radial double impulse escapement, as illustrated schematically in FIG. 1E. This escapement corresponds to the Robin escapement, but the missing beat per oscillation in single beat escapements is replaced by an indirect impulse realized by means of a third pallet-stone L positioned centrally on the pallets, which transmits a torque to the balance by means of the pin R. The impulse is radial and therefore, in principle, does not necessitate lubrication, and the suppression of the single beat should, in principle, remedy the problem concerning the self-starting of the single-beat escapements, such that this escapement retains certain advantages of the detent escapement whilst avoiding certain disadvantages of the Robin escapement. On the other hand, the geometry of this radial double impulse escapement is very particular due to the fact that the third pallet-stone positioned centrally on the pallets necessitates a special opening of the arms of the pallets as well as a very large angle of rotation of 30° comparable to the angle of lift of the balance. For this reason, the entry- and exit-pallets are not orthogonal to the circle of the escapement wheel, which increases the resistance to unlocking. In addition, this escapement is not self-starting either when the escapement wheel is at rest against the pallets. In order to remedy the problems of the radial double impulse escapement, George Daniels has moreover developed, amongst others, an escapement designated hereinbelow as "coaxial escapement" and illustrated schematically in FIG. 1F. The main difference of the coaxial escapement with respect to the radial double impulse escapement consists in the introduction, on the escapement wheel, of a second level of teeth concentric to the usual teeth of the escapement wheel, hence the designation "coaxial". The interior row of teeth of the escapement wheel is only present to facilitate the geometry of the indirect impulse, apart from that the functioning of the coaxial escapement is identical to that of the radial double impulse escapement, for which reason the coaxial escapement can also be considered as an escapement of the Robin type. With this new geometry, the arms of the pallets can again have a geometry permitting the entry- and the exit-pallets to be orthogonal to the circle of the escapement wheel, such that the geometry of the arms of the coaxial escapement is no longer detrimental to unlocking. However, the addition of a supplementary wheel formed by the second level of concentric teeth increases the complexity and adds mass to the escapement wheel, which is detrimental to its acceleration following unlocking. In addition, the industrialisation of this escapement has apparently necessitated a lubrication, which is contrary to the original motivation of using a detent escapement, respectively an escapement of the Robin type, so as to permit, in principle, the suppression of any lubrication at this level.

Following the review, by the way incomplete, of these different approaches envisaged by the past to integrate a detent escapement, respectively an escapement of the Robin type, into mechanical wristwatches, it is clear that there is still a potential to improve these escapements, the production of which remains relatively complicated and also costly, and which are normally reserved for integration into very high-end timepieces such as wristwatches equipped with a chronograph mechanism.

SUMMARY OF THE INVENTION

Consequently, an objective of the present invention is to remedy, at least partly, the disadvantages mentioned above, and to provide a detent escapement, preferably an escapement of the Robin type, and particularly preferably an escapement of the type described in European Patent EP 1 122 617, respectively in the patent application CH 712 288, whilst retaining the above-mentioned advantages of a detent escapement, by remedying the problem of the self-starting of the single-beat escapements, by further improving the security of functioning of these escapements and also by guaranteeing the feasibility in terms of industrial mass production. It is also an objective of the present invention to realize such an escapement by a construction which is robust and as simple as possible and reliable during use. The solution should be adapted to an integration into an escapement of the Robin type, but should permit its use also in other similar horological mechanisms. Another objective of the present invention is to realize a horological movement and a timepiece comprising such an escapement.

To this end, the present invention proposes an escapement of the above-mentioned type which is distinguished by the characteristics set forth in claim 1. In particular, the second mobile body of the proposed escapement comprises an indirect impulse means, such as an indirect impulse transmitter or generator, arranged and positioned such as to be, during the entire oscillation of the regulating organ during the normal functioning of the escapement, out of contact with the escapement wheel, whilst being capable of coming into contact, during the other half-phase of each oscillation of the regulating organ during which the escapement wheel does not transmit torque to the regulating organ by means of a direct impulse, with the escapement wheel, in order to transmit a torque to said regulating organ of the horological movement by means of an indirect impulse, via the second mobile body, following an inadvertent movement or an inadvertent stoppage of the horological movement. Preferably, the energy source is formed by, or comprises, a barrel spring and the regulating organ is formed by a balance, said first mobile body is formed by a roller carried by an axis of the balance and said second mobile body is formed by pallets, and said indirect impulse means is formed by an indirect impulse pallet-stone situated substantially close to the pivoting axis of the pallets. In a preferred embodiment, the escapement wheel comprises a number of teeth situated in the range of 13 to 19.

By these steps, the escapement has the above-mentioned advantages of a detent escapement, but does not present the problem concerning self-starting of the single-beat escapements, given that said indirect impulse pallet-stone comes into contact, following an inadvertent movement or an inadvertent stoppage of the horological movement and during the half-phase of the oscillation of the balance during which the escapement wheel does not transmit torque to the balance by means of a direct impulse, with the escapement wheel, and transmits a torque to the balance by means of an indirect impulse via the pallets. Thus, the self-starting in the event of inadvertent stoppage of the movement is ensured. In addition, this permits the security of functioning of the escapement to be further improved, in particular in the case of the AP escapement, because the integration of the indirect impulse pallet-stone permits the relaxation of the tolerances of the parts involved during the exit of the finger of the guard-pin outside the skirt, which allows constellations to be avoided in which a collision between said finger and said skirt of the locking device can occur. Furthermore, such an indirect impulse pallet-stone can be also be integrated in other types of lever escapements, such that the invention can be applied to several types of timepieces.

Other characteristics, and also the corresponding advantages, will emerge from the dependent claims as well as from the description explaining here below the invention in further detail.

BRIEF DESCRIPTION OF THE DRAWINGS

The attached drawings represent schematically and by way of example the prior art as well as an embodiment of the invention.

FIG. 1A represents by a perspective view a Swiss lever escapement, FIG. 1B shows by a top view a detent escapement, FIG. 1C shows by a top view a Robin escapement, FIG. 1D shows by a top view an escapement according to European patent EP 1 122 617, FIG. 1E shows by a top view the escapement designated as radial double impulse escapement and FIG. 1F shows by a top view the coaxial escapement.

The series of FIGS. 2A to 2J schematically illustrates by top views the principal phases of functioning of the escapement according to European patent EP 1 122 617, when the functioning of the escapement is taking place normally.

Figure 3:
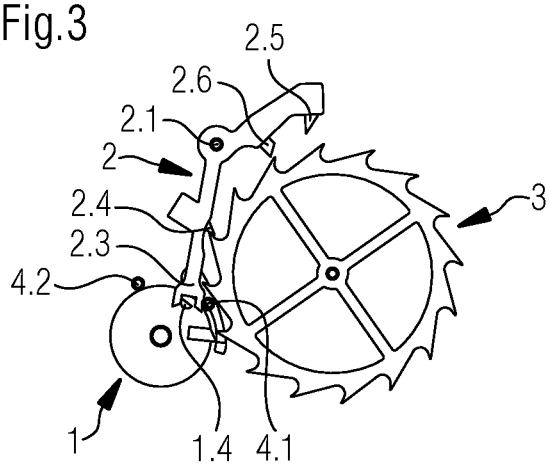
Figure 4A:
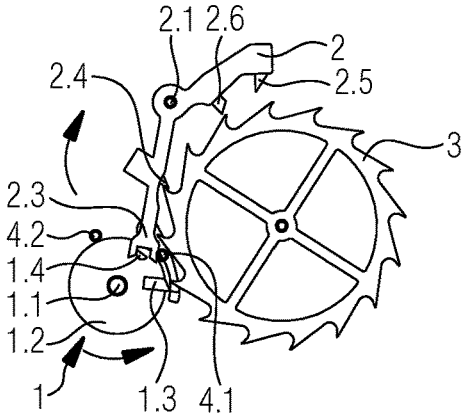
Figure 4B:
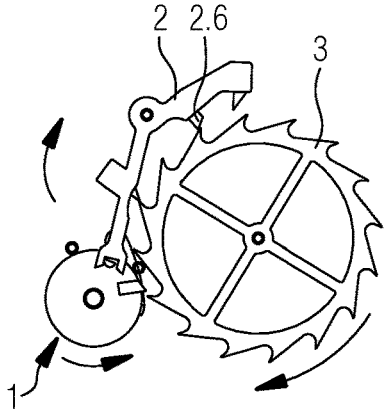
Figure 4C:
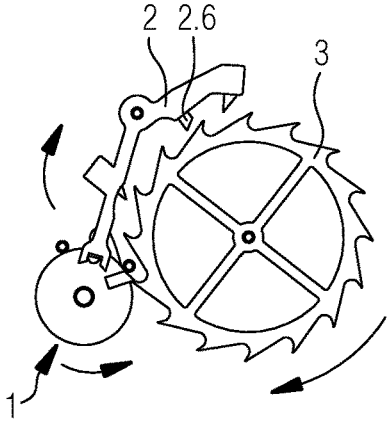
Figure 4D:
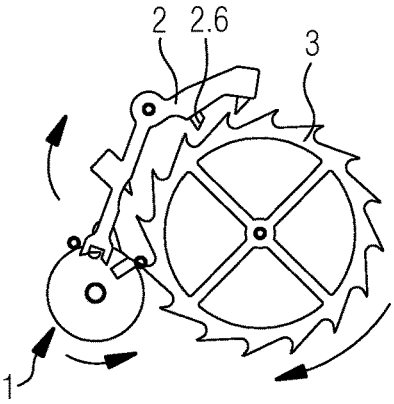
Figure 4E:
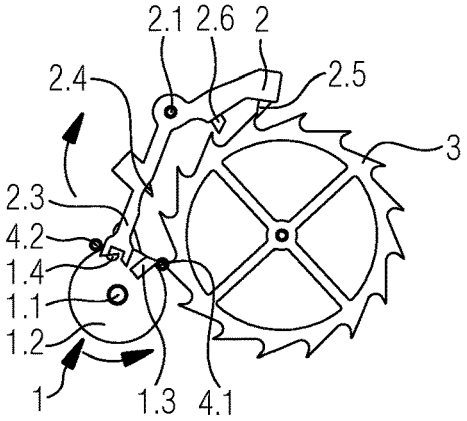
Figure 4F:
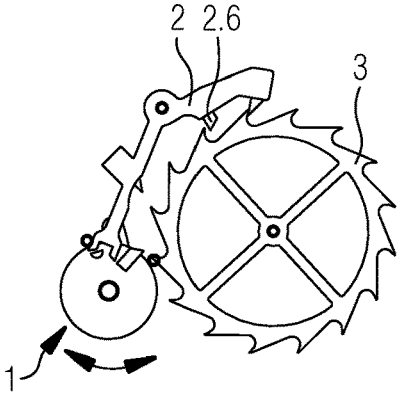
Figure 4G:
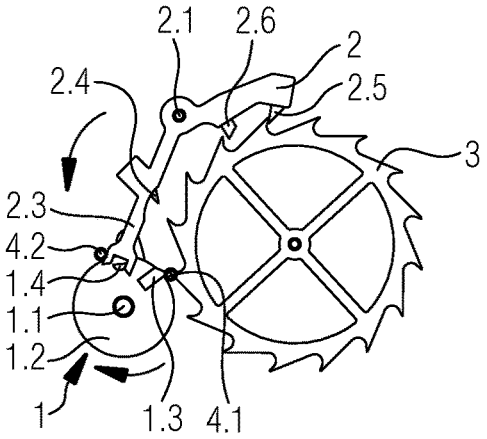
Figure 4H:
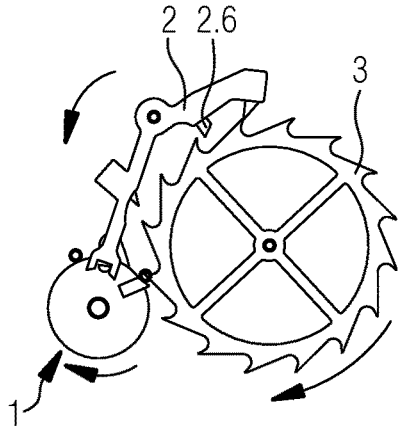
Figure 4I:
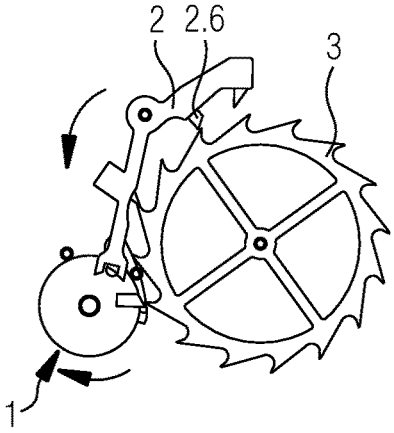
Figure 4J:
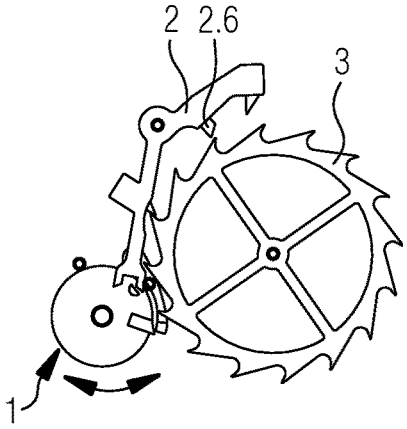

FIG. 3 shows by a schematic top view an escapement according to the present invention.

The series of FIGS. 4A to 4J schematically illustrates by top views the principal phases of functioning of the escapement according to the present invention, when the functioning is taking place normally.

Figure 5:
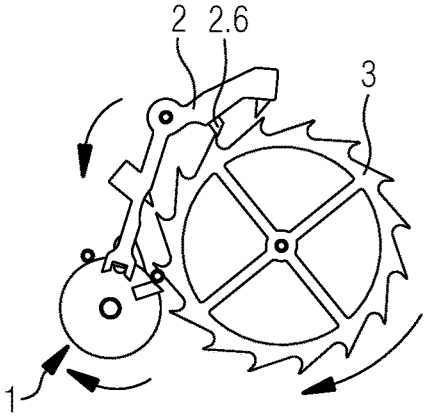

FIG. 5 schematically illustrates by a top view a phase of functioning of the escapement according to the present invention when the functioning of the escapement is taking place abnormally, following an inadvertent movement or an inadvertent stoppage of the horological movement, the indirect impulse means in this case coming into contact with the escapement wheel and transmitting a torque to the regulating organ by means of an indirect impulse via the second mobile body.

DETAILED DESCRIPTION OF THE INVENTION

The invention will now be described in detail with reference to the attached drawings illustrating by way of example an embodiment of the invention.

The present invention relates to an escapement intended to be integrated in a timepiece, preferably in a wristwatch. For reasons of simplification of the language used, reference will be made below indiscriminately to "timepiece" and "watch", without, however, wishing to limit the scope of the corresponding explanations which extend to any type of timepieces. In particular, an escapement according to the present invention is a direct impulse escapement, in particular an escapement of the Robin type, and the invention is, in a particularly preferred manner, realized by an escapement as described in European patent EP 1 122 617, respectively in the patent application CH 712 288. Although the following description will only explain in detail the specific case of the integration of the invention in an escapement as described in European patent EP 1 122 617, a use of the invention in combination with other types of escapement is possible, and the following explanations extend by analogy to any type of detent escapement, i.e. to any type of direct impulse escapement as well as to various types of lever escapement.

In order to allow for a better understanding of the context of the present invention, the following description will briefly recall the structure and the functioning of an escapement according to European patent EP 1 122 617. Given that the lever escapements in general and the direct impulse escapement described in European patent EP 1 122 617 are known to the person skilled in the art, this part of the description will be limited, as far as possible, to the facts linked to the context of the present invention. Likewise, the nomenclature used in European patent EP 1 122 617 will also be used, as far as possible, in the present description.

Figure 1A:
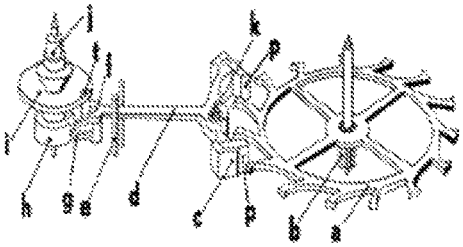
Fig.1A Prior Art
FIGS. 1A to 1F illustrate schematically various escapements according to the prior art.
Figure 1B:
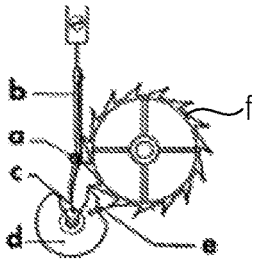
Fig.1B Prior Art
Figure 1C:
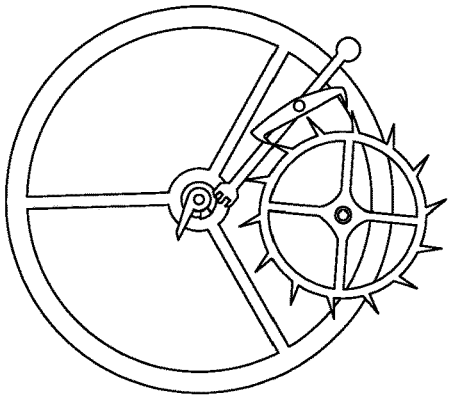
Fig.1C Prior Art
Figure 1D:
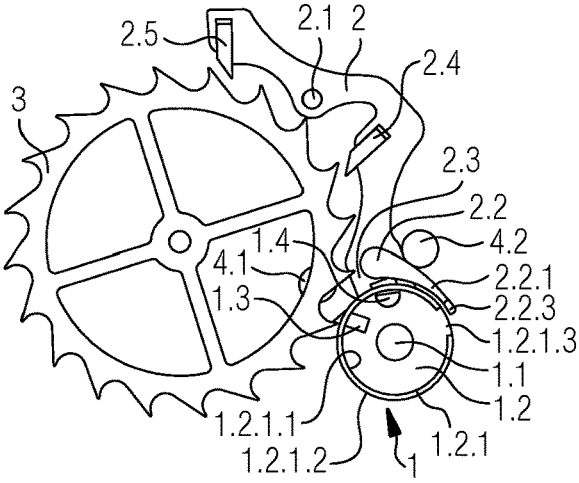
Fig.1D Prior Art

FIG. 1D is a top view of an escapement according to European patent EP 1 122 617 which allows its structure to be easily understood. This escapement includes, in generic terms, a first mobile body 1 and a second mobile body 2. The first mobile body 1 turns about an axis 1.1 and is capable of stopping the second mobile body 2 in a first or a second position defined respectively by a first—and a second banking 4.1, 4.2 against which said second mobile body 2 comes to rest. The first mobile body 1 is realized by a roller, respectively by a circular plate 1.2 surrounded by a skirt 1.2.1 having internal 1.2.1.1 and external 1.2.1.2 walls, said skirt 1.2.1 having a notch 1.2.1.3 arranged such as to be traversed by a finger 2.2.3 fixed on the second mobile body 2. As described in further detail in European patent EP 1 122 617 to which reference is made with respect to this point, the second mobile body 2 can be given a rectilinear movement, such that its finger 2.2.3 always moves radially to the first rotating mobile body 1, this configuration not being illustrated in the figures, or can be given an angular movement, by being articulated about a pivoting centre 2.1, the pivoting centre 2.1 being selected such that its finger 2.2.3 also moves substantially radially to the first rotating mobile body 1 when it traverses the notch 1.2.1.3 of said skirt 1.2.1. These two variants being equivalent at the functional level for the present invention, it is only this latter configuration which will be described in detail below and which is illustrated in the figures. In all cases, the second mobile body 2 is stopped in the first position when it is resting on the first banking 4.1 and its finger 2.2.3 adjoins the internal wall 1.2.1.1 of the skirt 1.2.1 and it is stopped in the second position when it is resting on the second banking 4.2 and its finger 2.2.3 adjoins the external wall 1.2.1.2 of said skirt 1.2.1. For further details of structural nature of this device, reference is made to European patent EP 1 122 617.

The functioning of the escapement according to European patent EP 1 122 617 will be explained briefly below with reference to FIG. 1D and to the series of FIGS. 2A to 2J which illustrates, schematically and at each position by top views, ten principal phases of functioning of an escapement of the Robin type equipped with the locking device according to European patent EP 1 122 617, each phase being illustrated at the start of the corresponding movement. In this case, the balance of the escapement acts as first rotating mobile body 1 and the pallets act as second mobile body 2. In FIGS. 2A to 2J, and in FIG. 1D, the balance 1 is not illustrated in its entirety, but is represented by the small circular roller 1.2 surrounded by the skirt 1.2.1 which is coaxially integral with the axis 1.1 of the balance 1, the latter also carrying the impulse roller which is not illustrated in the figures, which is also coaxially integral with the axis 1.1 and which is equipped with a direct impulse pallet-stone 1.3 as well as with a pin 1.4. Furthermore, the pallets 2 mounted in a pivoting manner about the pivoting centre 2.1 have a guard-pin 2.2 as described in European patent EP 1 122 617 carrying said finger 2.2.3 of the pallets 2, a fork 2.3 cooperating with said pin 1.4 as well as an entry lock pallet-stone 2.4 and an exit lock pallet-stone 2.5 cooperating in a manner well known to the person skilled in the art with the escapement wheel 3. The latter also cooperates with said direct impulse pallet-stone 1.3 in order to directly transmit an impulse to the balance 1. The nomenclature used above and the usual function of these parts in a lever escapement are known to the person skilled in the art.

Figure 2A:
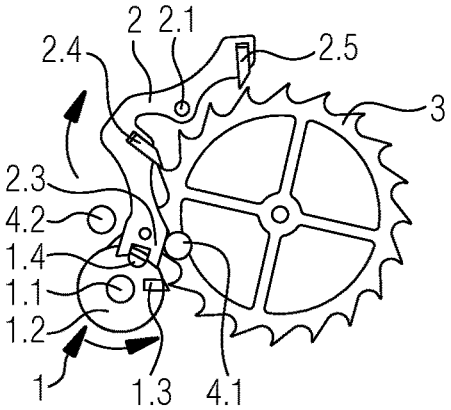
Fig.2A Prior Art

FIG. 2A shows an escapement of the Robin type equipped with the locking device according to European patent EP 1 122 617, viewed from above, during the phase commonly designated "entry unlocking", in which a tooth of the escapement wheel 3 rests on the entry lock pallet-stone 2.4 of the pallets 2, such that the escapement wheel 3 cannot rotate. The balance 1 is situated at the start of its half-oscillation in anti-clockwise direction, viewed from above according to FIG. 2A, the pin 1.4 on its impulse roller beginning to engage the fork 2.3 of the pallets 2 in order to push the latter, which, referring also to FIG. 1D, were locked in the first position due to resting on the first banking 4.1 and its finger 2.2.3 adjoining the internal wall 1.2.1.1 of the skirt 1.2.1 of the safety roller of the balance 1, so as to unlock the entry lock pallet-stone 2.4 of the pallets 2 from the tooth of the escapement wheel 3 resting on it. This movement is made possible by the rotation of the balance 1 which brings the notch 1.2.1.3 arranged in said skirt 1.2.1 into a position allowing the finger 2.2.3 to traverse it, such that the finger 2.2.3 passes, during the subsequent steps, from the internal wall 1.2.1.1 to the external wall 1.2.1.2 of the skirt 1.2.1. The movements of the different parts are symbolised in the series of FIGS. 2A to 2J by corresponding arrows.

Figure 2B:
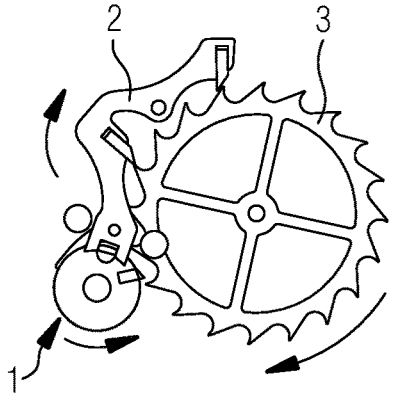
Fig.2B Prior Art

Referring to FIGS. 1D and 2B, the escapement is shown, again viewed from above, during the phase designated "impulse drop", in which the pin 1.4 on the impulse roller of the balance 1 has pushed the pallets 2 sufficiently far so that the tooth of the escapement wheel 3, having previously rested on the entry lock pallet-stone 2.4 of the pallets 2, is released, such that the escapement wheel 3 turns, under the effect of the driving force of the spring of the barrel transmitted by the gear train of the corresponding timepiece, in clockwise direction, still viewed from above.

Figure 2C:
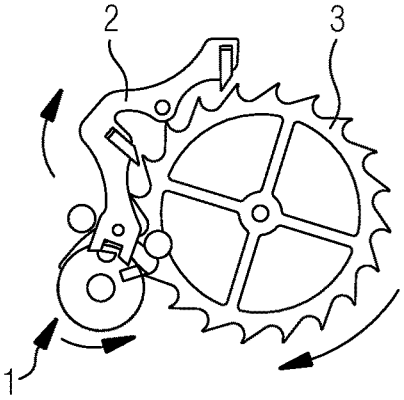
Fig.2C Prior Art

Referring to FIGS. 1D and 2C, the escapement is shown, viewed from above, during the phase designated "impulse", in which the escapement 3 has rotated, under the effect of the driving force of the spring of the barrel, up to the point at which one of its teeth is touching the direct impulse pallet-stone 1.3 fixed on the impulse roller of the balance 1, such as to directly transmit an impulse to the balance 1 in order to maintain its oscillation. During this movement, the pin 1.4 on the impulse roller of the balance 1 continues to push the pallets 2 in clockwise direction.

Figure 2D:
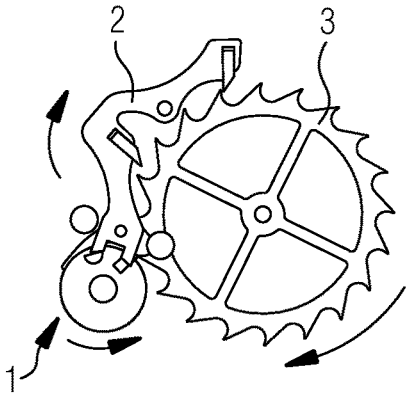
Fig.2D Prior Art

Referring to FIGS. 1D and 2D, the escapement is shown, viewed from above, during the phase designated "entry drop", in which the pallets 2 have rotated sufficiently in clockwise direction so that the exit lock pallet-stone 2.5 of the pallets 2 has penetrated in the trajectory of the teeth of the escapement wheel 3. The latter thus continues its rotation until one of its teeth engages with said exit lock pallet-stone 2.5 of the pallets 2, the escapement wheel 3 being thus stopped again, while the balance 1 and the pallets 2 continue their half-oscillation in anti-clockwise direction, respectively pivoting in clockwise direction, viewed from above.

Figure 2E:
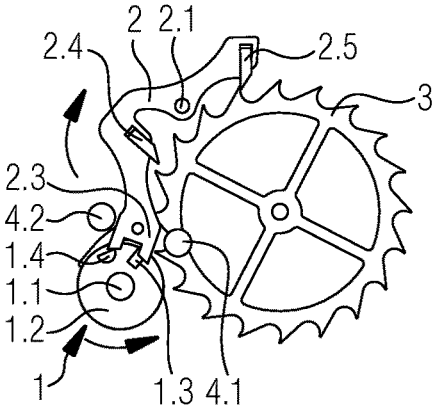
Fig.2E Prior Art

Referring to FIGS. 1D and 2E, the escapement is shown, viewed from above, during the phase designated "entry backlash", in which the escapement wheel 3 is effectively stopped, one of its teeth resting on the exit lock pallet-stone 2.5 of the pallets 2, while the balance 1 and the pallets 2 still continue their half-oscillation in anti-clockwise direction, respectively pivoting in clockwise direction, viewed from above.

Figure 2F:
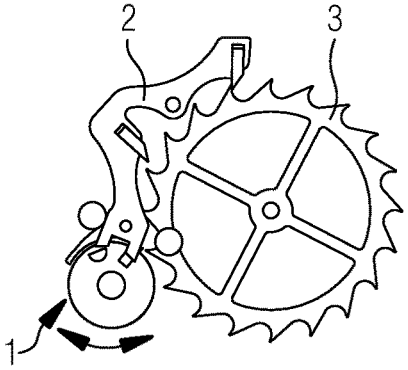
Fig.2F Prior Art

Referring to FIGS. 1D and 2F, the escapement is shown, viewed from above, during the phase designated "exit lock", in which the escapement wheel 3 is still stopped by the exit lock pallet-stone 2.5 of the pallets 2, the latter now being stopped in the second position, as resting on the second banking 4.2 and its finger 2.2.3 adjacent to the external wall 1.2.1.2 of the skirt 1.2.1 of the safety roller of the balance 1. The balance 1, in turn, its situated at the dead point of its half-oscillation in anti-clockwise direction.

Figure 2G:
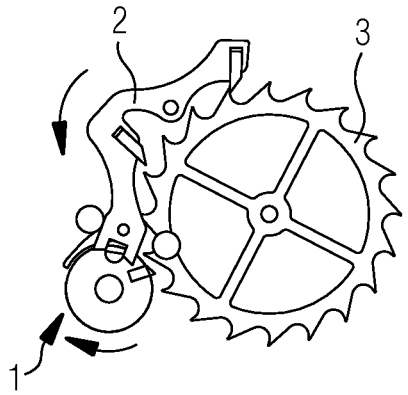
Fig.2G Prior Art

Referring to FIGS. 1D and 2G, the escapement is shown, viewed from above, during the phase designated "exit unlocking", in which, at the start of this functioning step, a tooth of the escapement wheel 3 rests on the exit lock pallet-stone 2.5 of the pallets 2, so that the escapement wheel 3 cannot yet rotate. The balance 1 is situated at the start of its half-oscillation in clockwise direction, viewed from above according to FIG. 2G, the pin 1.4 on its impulse roller beginning to engage the fork 2.3 of the pallets 2 in the other direction in order to push the latter, which were situated as mentioned above stopped in the second position as resting on the second baking 4.2 and its finger 2.2.3 adjacent to the external wall 1.2.1.2 of the skirt 1.2.1 of the safety roller of the balance 1, in anti-clockwise direction, viewed from above, such as to unlock the exit lock pallet-stone 2.5 of the pallets 2 from the tooth of the escapement wheel 3 resting on it. This movement is made possible by the rotation of the balance 1 which brings the notch 1.2.1.3 arranged in said skirt 1.2.1 in a position allowing the finger 2.2.3 to traverse it, such that the finger 2.2.3 passes back, during the following steps, from the external wall 1.2.1.2 to the internal wall 1.2.1.1 of the skirt 1.2.1.

Figure 2H:
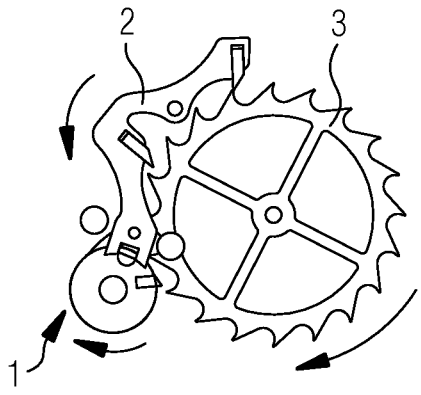
Fig.2H Prior Art

Referring to FIGS. 1D and 2H, the escapement is shown, viewed from above, during the phase designated "exit drop", in which the pin 1.4 on the impulse roller of the balance 1 has pushed the pallets 2 sufficiently far so that the tooth of the escapement wheel 3, having previously rested on the exit lock pallet-stone 2.5 of the pallets 2 is released, such that the escapement wheel 3 rotates, under the effect of the driving force of the spring of the barrel transmitted by the gear train of the corresponding timepiece, in clockwise direction, viewed from above. During this movement, the balance 1 continues its half-oscillation in clockwise direction and the pin 1.4 on the impulse roller of the balance 1 continues to push the pallets 2 in anti-clockwise direction, such that the entry lock pallet-stone 2.4 of the pallets 2 penetrates again in the trajectory of the teeth of the escapement wheel 3. The latter thus continues its rotation until one of its teeth engages with said entry lock pallet-stone 2.4 of the pallets 2, the escapement wheel 3 being then stopped again. During this phase, the escapement wheel 3 does not transmit an impulse to the balance 1, because the direct impulse pallet-stone 1.3 is arranged and placed in such a manner on the impulse roller that it is not touched by the teeth of the escapement wheel 3 when the balance 1 carries out its half-oscillation in clockwise direction.

Figure 2I:
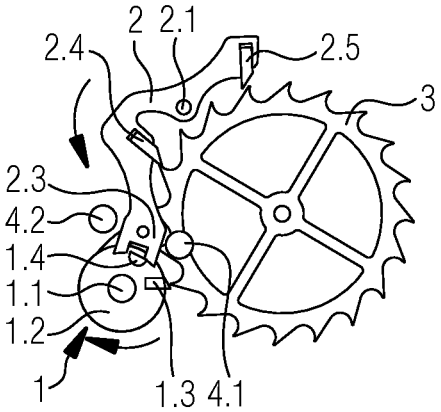
Fig.2I Prior Art

Referring to FIGS. 1D and 2I, the escapement is shown, viewed from above, during the phase designated "exit backlash", in which the escapement wheel 3 is effectively stopped, one of its teeth resting on the entry lock pallet-stone 2.4 of the pallets 2, while the balance 1 and the pallets 2 still continue their half-oscillation in clockwise direction, respectively the pivoting in anti-clockwise direction, viewed from above.

Figure 2J:
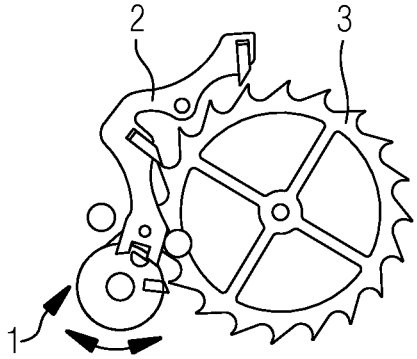
Fig.2J Prior Art

Referring to FIGS. 1D and 2J, the escapement is shown, viewed from above, during the phase designated "entry lock", in which the escapement wheel 3 is still stopped by the entry lock pallet-stone 2.4 of the pallets 2, the latter being again stopped in the first position as resting on the first banking 4.1 and its finger 2.2.3 adjacent to the internal wall 1.2.1.1 of the skirt 1.2.1 of the safety roller of the balance 1. The balance 1, in turn, is situated at the dead point of its half-oscillation in clockwise direction, ready to recommence an oscillation cycle again, such that the steps described above repeat themselves.

In this context, it is to be noted that the description figuring above of the functioning of the escapement according to European patent EP 1 122 617 is also valid for the escapement according to the patent application CH 712 288 and, in principle, applies by analogy to any escapement of the Robin type, respectively to any lever escapement, having a single beat, i.e. having a half-phase during each oscillation of the regulating organ during which there is no impulse.

FIG. 3 shows a schematic top view of an escapement according to the present invention. It can be seen therefrom that, in generic terms, such an escapement is adapted to be integrated in a horological movement and arranged to transmit a torque originating from an energy source of said horological movement to an oscillating regulating organ of said horological movement, the regulating organ of the horological movement comprising a first mobile body 1 and the escapement comprising a second mobile body 2 and also an escapement wheel 3. The first mobile body 1 cooperates with the second mobile body 2 by being adapted to stop the second mobile body 2 in a first or a second position defined respectively by a first and a second banking 4.1, 4.2 against which said second mobile body 2 comes to rest. The escapement wheel 3 is arranged such as to transmit, during a half-phase of each oscillation of the regulating organ, a torque to said regulating organ by means of a direct impulse. In addition, the said second mobile body 2 comprises an indirect impulse transmitter arranged and positioned such as to be, during the whole oscillation of the regulating organ during the normal functioning of the escapement, out of contact with the escapement wheel 3, whilst being capable of coming into contact, during the other half-phase of each oscillation of the regulating organ during which the escapement wheel 3 does not transmit torque to the regulating organ by means of a direct impulse, with the escapement wheel 3, in order to transmit a torque to said regulating organ of the horological movement by means of an indirect impulse, via the second mobile body 2, following an inadvertent movement or an inadvertent stoppage of the horological movement, in particular in order to ensure the self-starting of the horological movement.

In the majority of the practical realizations of a horological escapement, respectively of a horological movement, said energy source is formed by a barrel spring and said regulating organ is formed by a balance, said first mobile body 1 of the regulating organ of the horological movement being conventionally formed by a roller 1.2 carried by an axis 1.1 of the balance.

Furthermore, and as referred to in greater detail in European patent EP 1 122 617, the second mobile body 2 of the escapement can, in principle, be given an angular movement or a rectilinear movement. In the first case, said second mobile body 2 of the escapement is, preferably, formed by pallets 2, said roller 1.2 carried by an axis 1.1. of the balance being adapted to cooperate with said pallets 2.

As regards more particularly the realization of said indirect impulse means or transmitter 2.6 of an escapement according to the present invention, it is preferably formed by an indirect impulse pallet-stone 2.6 situated substantially close to the pivoting axis of said second mobile body 2, respectively of said pallets 2. Preferably, said indirect impulse pallet-stone 2.6 is situated on the first half, close to said pivoting axis, of the arm of the pallets 2 carrying the exit lock pallet-stone 2.5, as illustrated in FIG. 3. This indirect impulse pallet-stone 2.6 can be produced in one piece with the pallets 2 or by a separate part mounted on the pallets 2. Preferably, the indirect impulse pallet-stone is realized by a separate part and made from a low-friction and low-wear material, such as ruby or sapphire.

As regards the realization of the escapement wheel 3 of an escapement according to the present invention, it comprises, in a preferred embodiment illustrated in FIG. 3, a number of teeth situated in the range of 13 to 19.

In addition, an escapement according to the present invention comprises, in a preferred embodiment, a locking device according to European patent EP 1 122 617, the structure and functioning of such a device having been described above and applying in an identical manner to an escapement according to the present invention comprising such a locking device. In a particularly preferred embodiment, an escapement according to the present invention also includes at least one securing and guiding surface as mentioned above and as described in detail in the patent application CH 712 288, this description of the structure and functioning of such a securing and guiding surface likewise applying in an identical manner to an escapement according to the present invention comprising such a securing and guiding surface.

As regards the functioning of an escapement according to the present invention, FIGS. 4A to 4J show by schematic top views the principal phases of functioning of the escapement according to the present invention, when the functioning is taking place normally, the invention being in these figures applied to the escapement according to European patent EP 1 122 617. In this context, it is to be noted that the description appearing above, with reference to FIGS. 2A to 2J, of the functioning of the escapement according to European patent EP 1 122 617 is wholly valid for this embodiment of an escapement according to the present invention. This point also applies to the embodiment of an escapement according to the present invention comprising at least one securing and guiding surface according to the patent application CH 712 288, respectively applies by analogy to all embodiments of an escapement according to the present invention, i.e. to any escapement of the Robin type, or even to any lever escapement, having a single beat, i.e. having a half-pass during each oscillation of the regulating organ during which there is no transfer of impulse, and being equipped with an indirect impulse means 2.6 according to the present invention. In fact, apart from the presence of said indirect impulse means 2.6 on the second mobile body 2 and a different number of teeth of the escapement wheel 3, the structure and the normal functioning of an escapement according to the present invention are identical to those of the escapement according to European patent EP 1 122 617, respectively to those of a corresponding escapement of the Robin type, given that the indirect impulse means 2.6 only takes an active role when an abnormal situation arises. Consequently, all the explanations appearing above in the context of the series of FIGS. 2A to 2J are valid for the normal functioning of an escapement according to the present invention as illustrated in the series of FIGS. 4A to 4J which show the same principal phases of normal functioning of an escapement according to the present invention as the series of FIGS. 2A to 2J. For reasons of simplicity, these explanations will not be repeated here, applying by analogy to the series of FIGS. 4A to 4J.

As regards the functioning of an escapement according to the present invention when an anomaly occurs, in particular following an inadvertent movement or an inadvertent stoppage of the horological movement, FIG. 5 illustrates by a schematic top view a phase of functioning of the escapement according to the present invention during which the indirect impulse means 2.6 takes an active role. In fact, when the functioning of the escapement takes place abnormally, following an inadvertent movement or an inadvertent stoppage of the horological movement, the indirect impulse means 2.6 comes in contact with one of the teeth of the escapement wheel 3 and transmits a torque to the regulating organ by means of an indirect impulse via the second mobile body 2. The indirect impulse pallet-stone 2.6 can also give an impulse to the balance when its amplitude reduces following the letting down of the barrel, which can be designated as an "impulse at order", this case not being illustrated in the figures. The present invention thus allows to avoid the disadvantages of the escapements of the prior art, mentioned in the introduction, by proposing an escapement which, in addition to the components of the escapement according to European patent EP 1 122 617, respectively in general of a detent escapement, or of the Robin type, further comprises said indirect impulse means 2.6, preferably in the form of an indirect impulse pallet-stone mounted close to the pivoting axis of the pallets 2, this indirect impulse means 2.6 remaining out of contact with the escapement wheel 3 during the whole oscillation of the regulating organ during the normal functioning of the escapement and only intervening during an abnormal functioning to carry out a transfer of an indirect impulse.

Figure 1E:
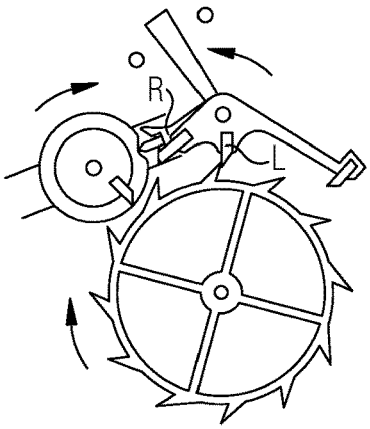
Fig.1E Prior Art
Figure 1F:
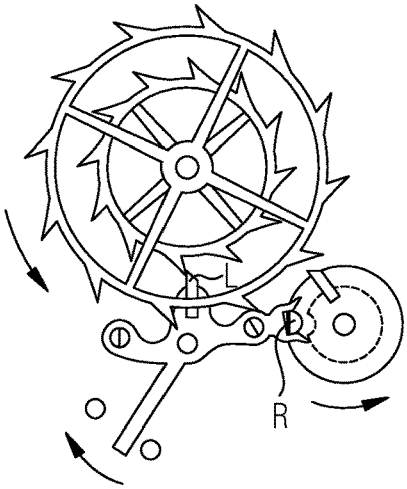
Fig.1F Prior Art

In this context, it can be added that, about fifty years ago, by carrying out observations with a high speed camera, horologists were surprised to observe that during the functioning of the lever escapement, after its release by the balance, the escapement wheel travels a substantial path before one of its teeth catches up one of the pallet-stones of the pallets. In fact, almost one third of the length of the entry- and exit-pallets of conventional pallets is not used because the corresponding tooth of the escapement wheel has not yet succeeded in making contact. This is also the case for the direct impulse escapements, in which the teeth of the escapement wheel must catch up the impulse pallet-stone situated on the impulse roller of the balance so as to carry out a transfer of a direct impulse. In the two cases, this is generally considered as a fault and various means are used to minimize it. An escapement according to the present invention having an indirect impulse pallet-stone on the pallets which is not caught up at all by the teeth of the escapement wheel during the normal functioning of the escapement, i.e. which does not take part at all in the normal functioning of the escapement, but which only intervenes during an abnormal functioning, is therefore to a certain extent contrary to the traditional technical teaching in the field of horology. On the other hand, in the case of loss of amplitude, shock or the tendency to stoppage of the escapement, one of the teeth of the escapement wheel comes in contact with the indirect impulse pallet-stone and allows an indirect impulse to be carried out, which leads, if applicable, to the automatic re-starting, given that the presence of the indirect impulse pallet-stone 2.6 brings an additional geometric constraint which is exploited during a specific phase of the functioning of the escapement and the geometry of which can be adapted as a function of the needs according to the practical case of application, for example by variation of the placement and/or of the form of the indirect impulse pallet-stone. It can also be noted at this point that the statement above is underlined by the configuration of the radial double impulse escapement mentioned in the introduction, given that the third impulse pallet-stone L positioned centrally on the pallets of this escapement, as can be seen in FIG. 1E, transmits systematically a torque to the balance at each half-phase of the oscillation of the regulating organ during which the escapement wheel does not transmit a torque to the regulating organ by means of a direct impulse, i.e. this third impulse pallet-stone always participates in the normal functioning of the radial double impulse escapement. Consequently, the present invention can also be realized in an escapement of the radial double impulse type or in the coaxial escapement which are mentioned in the introduction by replacing the third impulse pallet-stone present in and participating always in the normal functioning of these escapements by an indirect impulse pallet-stone 2.6 according to the present invention, which only intervenes during an abnormal functioning of the escapement.

In view of the arrangement and the functioning of a horological escapement according to the present invention, as described above, the person skilled in the art will understand that the present invention can be realized in any type of direct impulse escapement, in particular in a Robin escapement and, particularly preferably, in an escapement according to European patent EP 1 122 617 and according to the patent application CH 712 288. Generally, the present invention can be realized in any type of lever escapement having a single beat, without it being necessary or possible to mention all the cases of figures and all the corresponding details here. In view of the technical teaching appearing above, the person skilled in the art will also understand that the present invention concerns not only such an escapement, but also a horological movement comprising an energy source, a regulating organ, a gear train as well as such a horological escapement. In addition, the present invention also concerns a timepiece, preferably a mechanical wristwatch, comprising such a horological escapement, respectively such a horological movement. Preferably, it concerns a wristwatch having a chronograph mechanism or split-time counter mechanism, in which the advantages of a direct impulse escapement can be exploited particularly advantageously.

A horological escapement according to the present invention therefore allows the problem concerning self-starting of the single-beat escapements to be prevented, given that its indirect impulse pallet-stone comes into contact, for example following an inadvertent movement or an inadvertent stoppage of the horological movement and during the half-phase of the oscillation of the balance during which the escapement wheel does not transmit torque to the balance by means of a direct impulse, with the escapement wheel and transmits by means of an indirect impulse via the pallets a torque to the balance which is sufficient for re-starting the horological movement. At the same time, the present invention allows, in the case of application to the escapement according to European patent EP 1 122 617 and to that according to the patent application CH 712 288, to secure in a complementary manner the second mobile body 2 during the phase of functioning of the device during which the finger 2.2.3 fixed on the second mobile body 2 traverses the notch 1.2.1.3 of said skirt 1.2.1 of the first mobile body 1, such that the notch 1.2.1.3 in the skirt 1.2.1 can be enlarged. Thus, the tolerances of the parts involved during the exit of the finger of the guard-pin outside the skirt can be relaxed, which allows constellations to be prevented in which a collision between said finger and said skirt of the locking device can occur. The indirect impulse means 2.6 therefore plays a role of self-starting means as well as, in a subsidiary manner, a role of securing means.

In summary, the present invention allows the realization of a horological escapement which has the above-mentioned advantages of a detent escapement and the self-starting of which in the case of inadvertent stoppage of the movement is ensured, such that it does not present the problem concerning self-starting of the single-beat escapements. In addition, the present invention allows the security of functioning of the escapement to be further improved, in particular in the case of the AP escapement, by allowing to relax the tolerances of the parts which are involved during the exit of the finger from the guard-pin outside the skirt and by thus preventing constellations in which a collision between said finger and said skirt of the locking device can occur. Furthermore, the proposed construction, consisting principally of the integration of an indirect impulse pallet-stone, is simple and robust and also reliable during the functioning of the escapement. Such an indirect impulse pallet-stone can be integrated in several types of detent escapement and/or lever escapement, such that the invention can be applied in a flexible manner to several types of timepieces. In particular, the invention can be applied, preferably, in mechanical wristwatches, notably in wristwatches equipped with a chronograph mechanism or split-time counter mechanism.

The invention claimed is:

1. A horological detent escapement adapted to be integrated in a horological movement and arranged to transmit a torque originating from an energy source of said horological movement to an oscillating regulating organ of said horological movement, the regulating organ of the horological movement comprising a first mobile body, the escapement comprising:

a second mobile body configured to cooperate with said first mobile body and configured to be stopped by the first mobile body in a first or a second position defined respectively by a first and a second banking against which said second mobile body comes to rest, the second mobile body comprising an indirect impulse transmitter; and an escapement wheel, said escapement wheel being arranged so as to transmit, during a half-phase of each oscillation of the regulating organ, a torque to said regulating organ via a direct impulse;

wherein said indirect impulse transmitter of the second mobile body is arranged and positioned so as to be, during the whole oscillation of the regulating organ during the normal functioning of the escapement, out of contact with the escapement wheel, while being capable of coming into contact, during another half-phase of each oscillation of the regulating organ during which the escapement wheel does not transmit torque to the regulating organ by means of a direct impulse, with the escapement wheel, so as to transmit a torque to said regulating organ of the horological movement by means of an indirect impulse, via the second mobile body, following an inadvertent movement or an inadvertent stoppage of the horological movement.

2. The horological detent escapement according to claim 1, wherein said energy source comprises a barrel spring and said regulating organ comprises a balance.

3. The horological detent escapement according to claim 2, wherein said first mobile body of the regulating organ of the horological movement comprises a roller carried by an axis of the balance.

4. The horological detent escapement according to claim 3, wherein said second mobile body of the escapement comprises pallets, said roller being adapted to cooperate with said pallets.

5. The horological detent escapement according to claim 1, wherein said escapement wheel comprises a number of teeth situated in the range of 13 to 19.

6. The horological detent escapement according to claim 3, wherein the first mobile body comprising said roller comprises a circular plate surrounded by a skirt having internal and external walls, said skirt having a notch arranged so as to be traversed by a finger fixed on the second mobile body, the second mobile body being stopped in the first position when it is resting on the first banking and its finger adjoins the internal wall of the skirt and being stopped in the second position when it is resting on the second banking and its finger adjoins the external wall of said skirt.

7. The horological detent escapement according to claim 6, wherein said second mobile body comprises at least one securing and guiding surface oriented in a direction substantially opposed to said finger so as to secure said second mobile body during a functioning phase of the escapement during which the finger fixed on the second mobile body traverses the notch of said skirt of the first mobile body.

8. The horological detent escapement according to claim 7, wherein said securing and guiding surface is arranged and positioned so as to be, during an impulse phase of the balance by the escapement wheel, at an exterior periphery of a trajectory of the escapement wheel of said escapement, so as to be capable of coming into contact with said escapement wheel in order to secure the second mobile body, respectively pallets comprised by said second mobile body, preventing it from returning, following an inadvertent movement, on the trajectory of the escapement wheel.

9. The detent horological escapement according to claim 1, wherein said second mobile body of the escapement is given an angular movement or a rectilinear movement.

10. The horological detent escapement according to claim 1, wherein said indirect impulse transmitter comprises an indirect impulse pallet-stone situated substantially close to the pivoting axis of said second mobile body.

11. The horological detent escapement according to claim 10, wherein said indirect impulse pallet-stone is made from a low-friction and low-wear material.

12. The horological detent escapement according to claim 11, wherein said indirect impulse pallet-stone comprises ruby or sapphire.

13. The horological detent escapement according to claim 1, wherein the escapement is a direct impulse escapement, the escapement wheel transmitting the direct impulse directly to the balance.

14. The horological detent escapement according to claim 13, wherein the escapement is a Robin-type escapement.

15. A horological movement comprising a train, wherein said horological movement also comprises the energy source, the regulating organ and the horological detent escapement according to claim 1.

16. A timepiece, comprising the horological detent escapement according to claim 1 or the horological movement according to claim 11.

17. A timepiece according to claim 16, wherein the timepiece is a chronograph watch or split-time counter watch.

18. The horological detent escapement according to claim 4, wherein said indirect impulse transmitter comprises an indirect impulse pallet-stone situated substantially close to a pivoting axis of said second mobile body and said pallets, said indirect impulse pallet-stone being situated on the first half, adjacent to said pivoting axis, of an arm of the pallets carrying an exit lock pallet-stone.

* * * * *